United States Patent [19]

Dickinson, deceased et al.

[11] Patent Number: 4,527,929

[45] **Date of Patent: * Jul. 9, 1985**

[54] ROLLER-GUIDED CUTTING TOOL

[76] Inventors: Lawrence C. Dickinson, deceased, late of Reno, Nev.; Krestine Corbin, executrix, 532-4 Woodside Oaks, Sacramento, Calif. 95825

[ * ] Notice: The portion of the term of this patent subsequent to Jan. 11, 2000 has been disclaimed.

[21] Appl. No.: 569,946

[22] Filed: Jan. 11, 1984

Related U.S. Application Data

[63] Continuation-in-part of Ser. No. 401,580, Jul. 26, 1982, , which is a continuation-in-part of Ser. No. 301,503, Sep. 14, 1981, Pat. No. 4,425,693, which is a continuation-in-part of Ser. No. 205,026, Nov. 7, 1980, Pat. No. 4,380,851, which is a continuation-in-part of Ser. No. 183,664, Sep. 2, 1980, Pat. No. 4,367,576.

[51] Int. Cl.[3] ..... B24B 39/00; B24B 39/02

[52] U.S. Cl. ..... 407/1; 29/90 R; 72/122; 401/22

[58] Field of Search ..... 29/90 R; 407/1; 408/22, 408/130; 72/122

[56] References Cited

U.S. PATENT DOCUMENTS

| | | | |
|---|---|---|---|
| 2,040,440 | 5/1936 | Maupin | 29/90 R |
| 2,045,787 | 6/1936 | Maupin | 29/90 R |
| 2,069,099 | 1/1937 | Satterthwaite | 29/90 R |
| 2,164,574 | 7/1939 | Christman | 29/90 R |
| 2,282,550 | 5/1942 | Trerice | 29/90 R |
| 3,656,333 | 4/1972 | Kruse | 72/122 |
| 3,736,633 | 6/1973 | Kalen | 72/122 |
| 3,791,000 | 2/1974 | Kunze | 29/90 R |
| 3,795,957 | 3/1974 | Steusloff | 407/1 |
| 3,980,442 | 9/1976 | Riekeles | 407/1 |
| 4,133,089 | 1/1976 | Heymanns | 29/90 R |
| 4,367,576 | 1/1983 | Dickinson | 29/90 R |
| 4,380,851 | 4/1983 | Dickinson | 29/90 R |
| 4,425,693 | 1/1984 | Dickinson | 29/90 R |

FOREIGN PATENT DOCUMENTS

| | | | |
|---|---|---|---|
| 835723 | 6/1981 | U.S.S.R. | 29/90 R |

*Primary Examiner*—Leonidas Vlachos
*Assistant Examiner*—Jerry Kearns
*Attorney, Agent, or Firm*—Townsend & Townsend

[57] ABSTRACT

A skiving and roller burnishing tool for finishing the internal surface of a cylindrical bore includes a cutting assembly and a pair of roller burnishing assemblies. Each roller assembly includes a plurality of frustoconical rollers mounted on a frustoconical bearing surface. By translating the individual rollers axially, the effective diameter of the outer surfaces of the roller can be changed. By applying a constant force on the rollers, the two roller assemblies hold the tool firmly in place inside the work piece, preventing accidental misalignment of the cutting tool. It has been found that this workpiece is particularly well suited for finishing relatively long bores.

4 Claims, 5 Drawing Figures

ROLLER-GUIDED CUTTING TOOL

The following application is a continuation-in-part of application Ser. No. 401,580, filed on July 26, 1982, which was a continuation-in-part of application Ser. No. 301,503, filed Sept. 14, 1981 and now U.S. Pat. No. 4,425,693, which was a continuation-in-part of application Ser. No. 205,026, filed Nov. 7, 1980 and now U.S. Pat. No. 4,380,851, which was a continuation-in-part of application Ser. No. 183,664, filed Sept. 2, 1980 and now U.S. Pat. No. 4,367,576.

BACKGROUND OF THE INVENTION

1. Field of the Invention

The present invention relates generally to an improved tool for finishing the interior wall of a cylindrical bore, and more particularly to a combined skiving and roller burnishing tool which is capable of finishing very long cylinders with minimum deviation from a truly straight cylindrical wall.

2. Description of the Prior Art

In order to prepare the interior wall of a cylinder, such as a pneumatic or hydraulic cylinder, to the close tolerances necessary for proper operation, the cylinder will first be cut to the final diameter by a "skiving" tool and the resulting rough surface then finished with a "burnishing" tool. Often, the skiving and burnishing operations will be performed simultaneously by a combined skiving and roller burnishing tool, which tools are commercially available.

Such a combined skiving and roller burnishing tool will include a cutting blade at its forward end to cut the interior of the cylinder to its approximate final diameter and a plurality of rollers spaced a short distance behind the cutting blade. By rotating the tool and moving it forward through the rough cut cylindrical bore, the cylinder is cut to its final size and finished in a single operation.

While the combined skiving and roller burnishing tools of the type just described are generally functional and provide high quality finished cylinders, their use on very long cylindrical bores can be problematic. It will be appreciated that when cutting and finishing a cylinder, it is desirable that only the cutting tool and the burnishing rollers be in contact with the interior cylindrical wall. Contact between any other portions of the tool and the cylindrical wall can scratch or mar the surface which, of course, is undesirable. Such limited contact between the tool and the cylindrical wall, however, can lead to misalignment of the tool, particularly when very long bores are being finished. The tools are mounted on drive members and the long drive members required for very long bores will not be completely rigid. Any bending in the drive member can cause the cutting blade to oscillate or wobble, causing minor undulations in the finished cylindrical wall. While such undulations may be very small, they may often exceed the close tolerances required for critical applications.

It would thus be desirable to provide a skiving and roller burnishing tool which will remain axially aligned with the cylinder despite bending in the associated drive member and is capable of finishing relatively long cylindrical bores to within very close tolerances.

SUMMARY OF THE INVENTION

According to the present invention, a skiving and roller burnishing tool is provided with at least two separate roller assemblies spaced apart axially along the tool. Each roller assembly includes a plurality of radially adjustable rollers which are biased outward under a constant, predetermined force. The use of a pair of roller assemblies assures the proper axial alignment of the tool within the cylindrical bore being finished. In this way, the cutting assembly at the forward end of the tool is held firmly in place and is not able to deviate from the desired straight path.

Each roller assembly includes a roller race having a central axis and a frustoconical outer surface tapering radially outward in the forward axial direction. A plurality of frustoconical rollers are arranged about the outer surface of the roller race with the smaller ends of the rollers facing forward. The angle of taper of the rollers is selected so that the outermost surface of each roller is parallel to the central axis of the tool. The rollers are biased forwardly so that the taper of the roller race causes them to move outwardly. By providing a constant forward biasing force, the outward burnishing force supplied by the rollers will also remain constant.

The particular mechanism for axially translating the rollers includes a roller pusher which directly engages the rear (enlarged) ends of the individual rollers and a roller cage having a plurality of slots. The roller cage circumscribes the roller race, and the slots and roller race together define cavities for loosely receiving the individual rollers. The rear end of the roller cage is coupled to the roller pusher so that forward motion of the roller pusher causes the rollers to move upward on the roller race, while rearward motion of the roller pusher retracts the rollers by means of the roller cage. This particular roller assembly is an improvement over the prior art assemblies where the rollers were moved both forward and backward by the roller cage. Use of the roller cage for both functions was problematic, often causing the rollers to bind within the roller cage and to cease functioning.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the specific description and drawings are for the purpose of illustration and description only and are not intended as a definition of the limits of the invention.

DESCRIPTION OF THE PREFERRED EMBODIMENTS

Figure 1A:
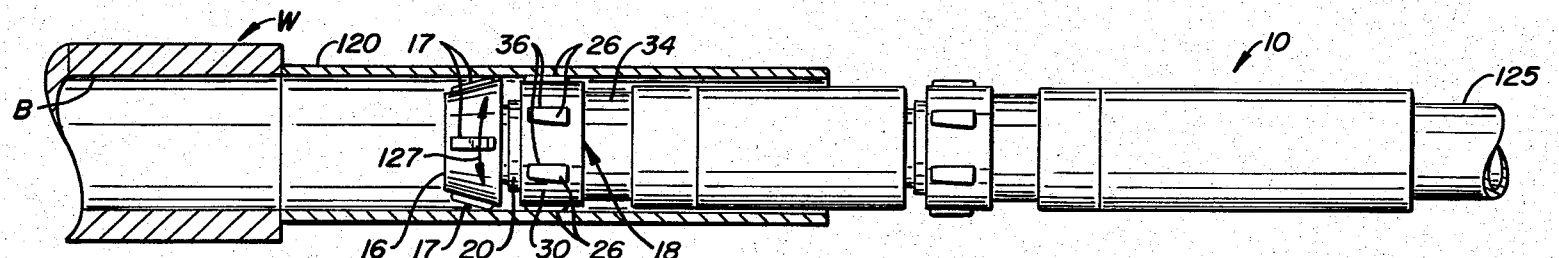
FIGS. 1A–1C illustrate a push-type embodiment of the skiving and roller burnishing tool of the present invention being inserted into a work piece using an alignment collar.

The skiving and roller burnishing tool of the present invention will generally comprise a skiving or cutting assembly mounted at one end of a drive tube assembly having a pair of roller assemblies axially spaced apart thereon. A connector is provided on the tool for attachment to a rotatable drive member for translating and rotating the tool through a work piece. The tool will be driven through the work piece with the cutting assembly leading followed by the two roller assemblies. By providing the connector at the rear end of the drive tube, the tool may be pushed through the work piece, as illustrated in FIGS. 1A–1C and 2. Alternately, the connector can be provided at the forward end of the drive tube, as illustrated in FIG. 3, for pulling the tool through the work piece.

Referring now to FIGS. 1A–1C and FIG. 2, the construction of the pull-type embodiment of the present invention will be discussed in detail. The tool 10 includes a drive tube assembly 12 having four segments 12*a*–12*d*. The segments 12*a*–12*d* are threadably connected to form the elongate drive tube assembly 12. The forwardmost tube segment 12*a* includes a threaded stud 14 at its forward end for receiving the cutter assembly 16. The cutter assembly may be any conventional fixed-blade cutter which functions to cut or skive the interior of a cylindrical bore as the tool 10 is rotated. As illustrated, the cutter assembly 16 includes a plurality of fixed cutting blades 17.

A first roller assembly 18 is located immediately to the rear of the cutter assembly 16. The first roller assembly includes a roller race 20 secured to the tube segment 12*a* by a key 22 so that the roller race 20 cannot rotate about the tube segment 12*a*. The roller race 20 has a frustoconical outer surface 24 having its largest dimension faced in the forward direction. A plurality of rollers 26 are received on the outer surface 24 and free to rotate thereabout. The rollers 26 are also frustoconical in section, having a taper so that the rollers 26 bearing on the surface 24 are aligned having their outer surfaces 28 parallel to the axis of the drive tube assembly 12.

The rollers 26 are held onto the roller race 20 by a roller cage 30. The roller cage 30 includes a plurality of slots or apertures 32 which receive individual rollers 26. The slots 32 restrict axial movement of the rollers 26, while allowing the rollers 26 to rotate on the surface 24 of roller race 20 as the tool 10 is rotated. The rollers 26 are able to radially translate to a limited degree as the roller cage 30 is moved axially, as will be described in greater detail hereinafter.

A roller pusher 34 having a forward lip 36 circumscribes the forward segment 12*a*. The forward lip 36 bears against the rear (large diameter) ends of the rollers 26, while a mating lip 38 on the roller cage 30 engages with the forward lip 36. In this way, the rollers 26 can be caused to translate in the forward axial direction by direct force of the roller pusher 34, while they can be drawn in the rear axial direction by means of the roller pusher 34 pulling on the roller cage 36.

The roller pusher 34, in turn, is actuated by a piston 40*a* which transmits force to the roller pusher 34 through a plurality of dowel pins 42. The dowel pins 42 are threadably connected to the roller pusher 34 but are unconnected at their opposite ends to the piston 40*a*. A spring 44 urges a plate 46*a* in the rearward direction. Plate 46*a*, in turn, bears against heads 48 of the dowel pins 42, urging the entire piston 40*a*, dowel pin 48, and roller pusher 34 assembly rearward. Thus, when no hydraulic pressure is exerted against the piston 40*a*, the roller pushers 34 will be in their most rearward disposition, causing the rollers 26 to be fully retracted.

First and second segments, 12*a* and 12*b*, respectively, may be disconnected to allow for insertion and removal of the piston 40*a*, plate 46*a*, and spring 44, in the event repair is necessary.

A second roller assembly 50, which is similar to the first assembly 18, is provided at the forward end of the third segment 12*c* of the drive tube assembly 12. The construction of the roller assembly 50 is substantially identical to that of the roller assembly 18, and corresponding elements will be given the same reference numbers. The only difference between the two assemblies is that a hydraulic tube 52 passes through the rear assembly 50, causing modification of the rear piston 40*b* and rear plate 46*b*. As will be described, the hydraulic tube 52 is required to deliver hydraulic fluid to the forward piston 40*a*.

Turning now to the hydraulic system, a hydraulic connector 54 is provided interior to a threaded end connection 56 located in the rear section 12*d* of the drive tube assembly 12. The hydraulic connector 54 is threadably received in an end plate 58 which extends across the interior of the tube 12. A gasket 60 is provided along the forward periphery of the end plate 58, providing a minimum clearance between the piston 40*b* and the end plate 58. Thus, as hydraulic fluid enters through the connector 54, the fluid will be able to enter the gap between the piston 40*b* and end plate 58 and cause the piston 40*b* to move forward.

The hydraulic tube 52 extends from the cavity at the rear of the first piston 40*b* to a similar cavity at the rear of the first piston 40*a*. Thus, a constant fluid pressure is maintained on both pistons 40*a* and 40*b* at all times. In this way, the pressure exerted on both the roller assemblies 18 and 50 by the roller pushers 34 will be substantially identical.

The rollers 26 will thus adapt themselves to the actual diameter of the interior of the cylinder being finished, and will apply an equal force throughout a range of diameters depending on the force applied to pistons 40*a* and 40*b*. If the interior of the cylinder deviates from the nominal diameter, the rollers will be able to adapt to the actual diameter and there will be less tendency for the tool to jam. More importantly, by firmly holding the tool 10 at two-spaced apart locations on the cylinder being finished, proper axial alignment of the tool within the cylinder is assured. Such alignment in turn, prevents accidental misalignment of the tool which can result in deviations and undulations in the finished interior wall.

Figure 1B:
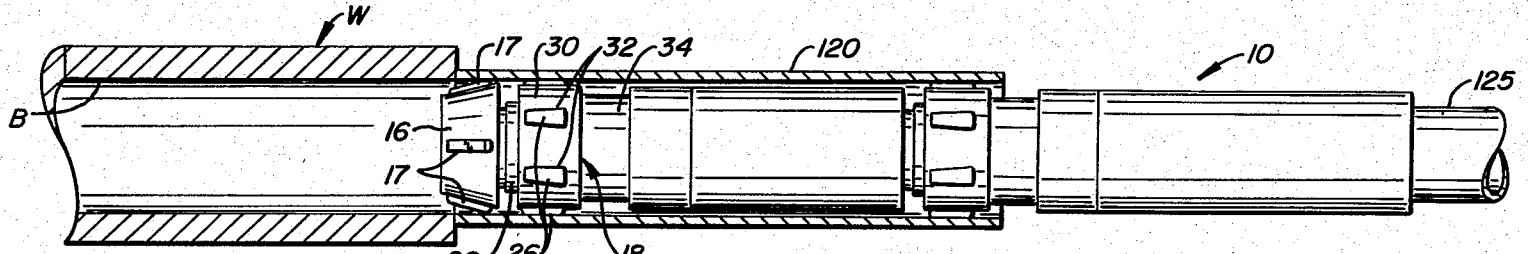
Figure 1C:
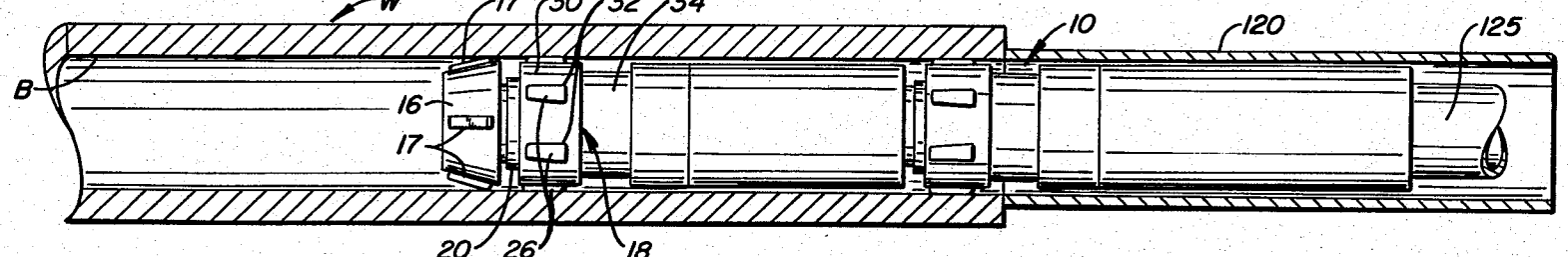
Figure 2:
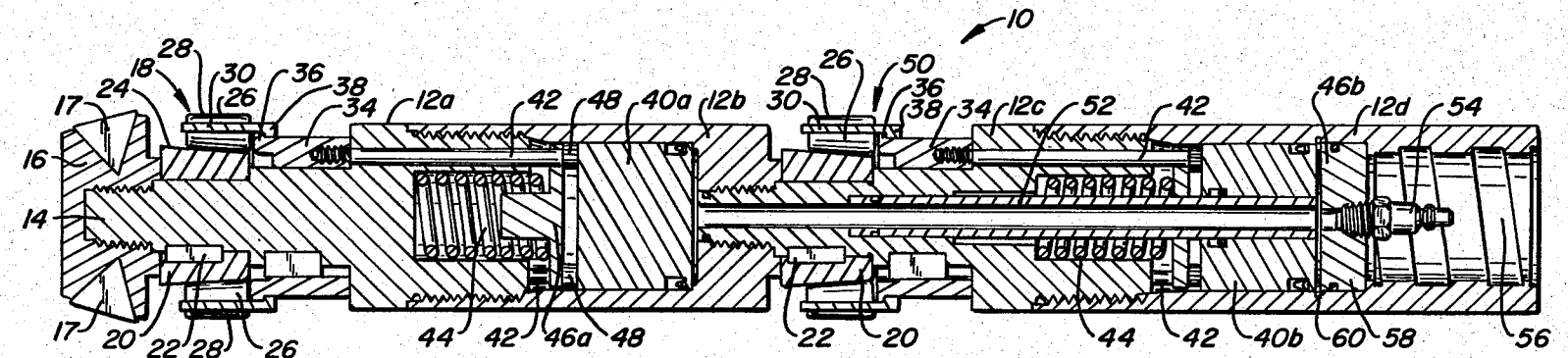
FIG. 2 is a sectional view of the push-type skiving and roller burnishing tool of the present invention.
Figure 3:
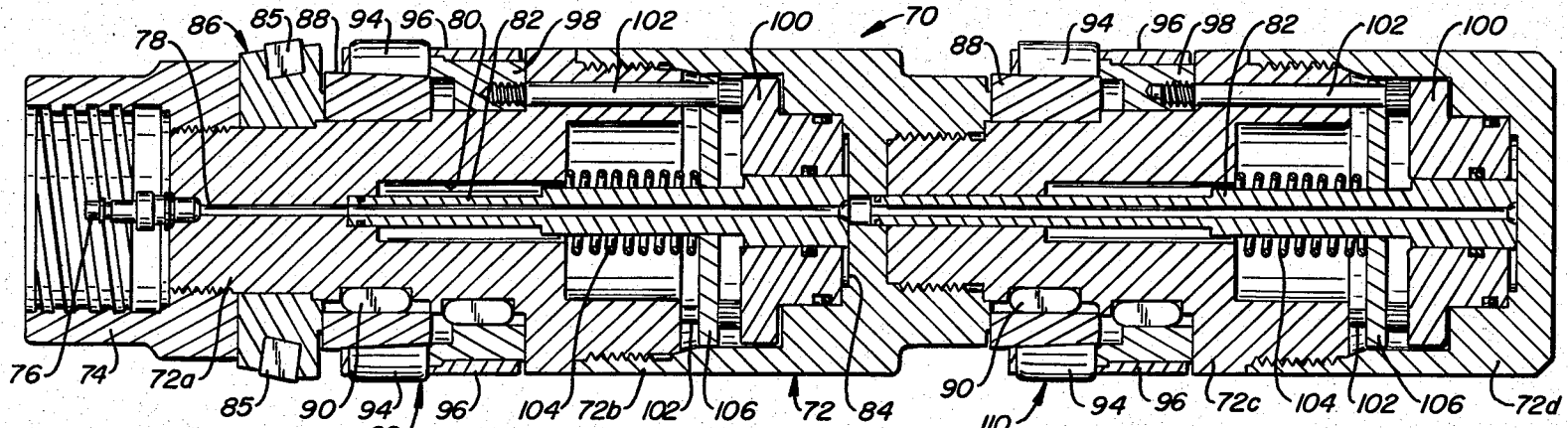
FIG. 3 is a sectional view of the pull-type skiving and roller burnishing tool of the present invention.

A second embodiment of the skiving and roller burnishing tool of the present invention is illustrated in FIG. 2. The primary difference between the embodiment of FIG. 1 and that of FIG. 2 lies in the location of the means for attaching the tool to the external drive member D (FIGS. 1A–1C). The embodiment of FIG. 3 includes the attachment means at the forward end of the tool, that is, the end which is drawn through the cylinder first.

The second embodiment 70 comprises a drive tube assembly 72 comprising four segments 72*a*–72*d*. The first segment 72*a* threadably receives a connector segment 74 at its forward end (that is, to the left as illustrated in FIG. 3). The connector 74, in turn is adapted to receive a drive member (not illustrated) for drawing the tool 70 through the work piece.

A hydraulic connector 76 is attached to the front end of segment 72*a* and connects with a bore 78 leading to an opening 80. A hydraulic tube 82 is connected at one end to the opening of the bore 78 and open at the other end to a cavity 84, as will be described hereinafter.

A cutter assembly 86 including a plurality of blades 85 circumscribes the forward segment 72*a* of the drive tube 72 and is located immediately to the rear of the connector 74. As described above, the construction of the cutter assembly 86 is not critical.

A first roller assembly 92 is located immediately to the rear of the cutter assembly 86. The first roller assembly includes a roller race 88 held in place by key 90 in the conventional manner. As described in connection with the first embodiment, the first roller assembly 92 will include a plurality of rollers 94 mounted on the roller race 88 and held in place by a roller cage 96. A roller pusher 98 is connected to a hydraulic piston 100 by a plurality of dowel pins 102, and the cavity 84 referred to earlier is defined between the rear face of the piston 100 and the second segment 72*b* of the drive tube 72. A spring 104 and pressure plate 106 are provided to urge the piston 100 rearward, and forward translation of the first roller assembly 92 is brought about by applying hydraulic fluid to the hydraulic connector 76.

A second roller assembly 110 is constructed in a similar manner. The only substantial difference is that the final segment 72*d* is a cap piece provided in place of the second segment 72*b*. The cap, of course, is closed since there is no need to transmit hydraulic fluid further down the tool. As before, identical elements will receive the identical reference numeral.

Referring again to FIGS. 1A–1C, operation of the pull-type embodiment of FIG. 2 will now be described. Conveniently, an alignment collar 120 will be aligned with the central bore B and the work piece W. The alignment collar 120 should be sufficiently long to extend across the cutting assembly 16 as well as both the roller assemblies 18 and 50. In this way, proper alignment of the tool is assured prior to entry of the cutting head into the work piece W.

Referring in particular to FIG. 1A, the tool 10 of the present invention is mounted on a drive member 125. The drive member 125 will be sufficiently long to pass the tool through the entire length of the cylindrical bore and will include means for rotating the tool as it is passed therethrough. As can be seen, when only the cutting assembly 16 and first roller assembly 18 are received in the alignment collar 120, movement of the drive member 125 away from axial alignment can cause an oscillation or wobble about the first roller assembly 18. Such oscillation is indicated by arrow 127 in FIG. 1A. The oscillation, in turn, can cause the cutting assembly 16 to move slightly from the desired path. As can be seen in FIG. 1B, however, as the second set of rollers enters the alignment tube 120, small movements of the drive member 125 will have a minimal effect on the alignment of the tool 10. That is simply because the two sets of roller assemblies 18 and 50 define a pair of points which hold the tool 10 firmly in place. This is particularly true because of the self adjusting natures of the individual rollers which fit tightly against the interior of the alignment tube. Thus, as the tool 10 finally enters the work piece W (as illustrated in FIG. 1C), proper alignment of the tool 10 is assured and the finishing operation can be completed in the conventional manner.

While the preferred embodiment of the present invention has been illustrated in detail, it is apparent that modifications and adaptations of the embodiment will occur to those skilled in the art. However, it is to be expressly understood that such modifications and adaptations are within the spirit and scope of the present invention, as set forth in the following claims.

What is claimed is:

1. A skiving and roller burnishing tool for mounting on a rotatable drive member to cut and burnish the interior of a cylinder or other workpiece, said tool comprising:

an elongate drive tube assembly having means for attachment to the drive member;

a cutting assembly attached to the drive tube assembly at a forward end thereof;

a first roller assembly having a plurality of radially adjustable rollers, said first roller assembly being located on the drive tube assembly to the rear of the cutting assembly; and a second roller assembly having a plurality of radially adjustable rollers, said second roller assembly being located on the drive tube assembly to the rear of the first roller assembly;

wherein the first and second roller assemblies each include:

a roller race having a central axis coincident with that of the drive tube assembly and a frustoconical outer surface tapering radially outward in the axially forward direction;

a plurality of frustoconically tapered rollers each having a large end and a small end and being arranged about said outer surface with the small ends of said rollers facing forward so that the surface portion of each roller furthest from the central axis of the roller race is generally parallel to said central axis;

a roller cage having a plurality of slots, said roller cage circumscribing and being spaced apart from the roller race so that said slots and said roller race together define a plurality of cavities for receiving individual rollers;

a roller pusher having (1) a forward extension for directly engaging the rear surfaces of individual rollers when the pusher is moved forwardly relative to the roller race to push the rollers forward and cause the rollers to translate radially outward along the tapered surface of the roller cage, and (2) a lip for directly engaging the roller cage when the pusher is moved rearwardly relative to the roller race to draw the rollers rearward and allow the rollers to translate radially inward;

means for biasing said roller pusher in said forward direction with a preselected force so that the force exerted upon said internal surfaces of said hole remains constant over a range of sizes of said hole; and means for retracting the roller pusher when the axial force is reduced to draw the roller cage rearwardly so that the rollers move radially inward and the tool can be withdrawn from the workpiece.

2. A skiving and roller burnishing tool as in claim 1, wherein the biasing means comprises a hydraulic cylinder operatively coupled to the roller pusher.

3. A skiving and roller burnishing tool for mounting on a rotatable drive member to cut and burnish the interior of a cylinder or other workpiece, said tool comprising:

an elongate drive tube assembly having means for attachment to the drive member;

a cutting assembly attached to the drive tube assembly at a forward end thereof; and first and second roller assemblies spaced-apart on the drive tube rearward of the cutting assembly, each of said roller assemblies comprising:

a roller bearing race drivably coupled to said drive tube assembly, said race having a frustoconical outer bearing surface tapering radially outward in the axially forward direction;

a plurality of frustoconically tapered roller bearings each having a large end and a small end;

cage means for loosely capturing said roller bearings for rolling engagement against said bearing surface, said roller bearings arranged with their large ends facing rearward and their small ends facing forward so that the portions of said roller bearings furthest from the bearing surface generally lie along an imaginary cylindrical surface coaxial with said drive axis, said cage means adapted to allow said roller bearings some radial movement;

a roller pusher having (1) a forward extension for directly engaging the rear surfaces of individual rollers when the pusher is moved forwardly relative to the roller race to push the rollers forward and cause the rollers to translate radially outward along the tapered surface of the roller race within the cavities defined by the roller cage, and (2) a lip for directly engaging the roller cage when the pusher is moved rearwardly relative to the roller race to draw the rollers rearward and allow the rollers to translate radially inward;

means for biasing said roller pusher in said forward direction with a first force so that said burnishing tool is rotatably advanced into said cylindrical hole with a generally constant second force even as the diameter of said cylindrical hole varies over a range of diameters; and means for retracting the roller pusher when the axial force is reduced to draw the roller cage rearwardly so that the rollers move radially inward and the tool can be withdrawn from the workpiece.

4. A burnishing tool as in claim 3, wherein the biasing means includes a fluid actuated piston and a plurality of dowel pins for coupling the piston to the roller pusher, said dowel pins resting against the piston but not attached thereto whereby the piston force is equally distributed across the roller pusher.

* * * * *